US005915670A

United States Patent [19]

Cain

[11] Patent Number: 5,915,670

[45] **Date of Patent: *Jun. 29, 1999**

[54] APPARATUS FOR LIFTING FURNITURE IN PLACE TO INSTALL FLOOR COVERING BENEATH IT

[76] Inventor: Bobby Cain, 5707A Gardendale, Houston, Tex. 77092

[ * ] Notice: This patent issued on a continued prosecution application filed under 37 CFR 1.53(d), and is subject to the twenty year patent term provisions of 35 U.S.C. 154(a)(2).

[21] Appl. No.: 08/910,056

[22] Filed: Aug. 12, 1997

Related U.S. Application Data

[63] Continuation of application No. 08/402,169, Mar. 9, 1995, abandoned.

[51] Int. Cl.[6] ..... B66F 11/00

[52] U.S. Cl. ..... 254/89 H; 254/133 R

[58] Field of Search ..... 254/DIG. 1, DIG. 4, 254/1, 2 R, 89 H, 8 B, 8 C, 100, 129, 131, 133 R, 93 H

[56] References Cited

U.S. PATENT DOCUMENTS

| | | | |
|---|---|---|---|
| 829,344 | 8/1906 | Larsen | 254/DIG. 1 |
| 2,469,670 | 5/1949 | Thompson | 254/93 H |
| 2,910,270 | 10/1959 | Schultz . | |
| 3,289,868 | 12/1966 | Miller et al. | 254/89 H |
| 4,275,778 | 6/1981 | Kotas | 254/93 H |
| 4,475,714 | 10/1984 | Heiskell et al. | 254/89 H |
| 4,807,851 | 2/1989 | De Castro . | |
| 4,846,443 | 7/1989 | Collins . | |
| 4,930,750 | 6/1990 | De Castro . | |
| 5,131,629 | 7/1992 | Hillhouse | 254/133 R |
| 5,181,694 | 1/1993 | Collins . | |
| 5,232,202 | 8/1993 | Watson | 254/1 |
| 5,261,643 | 11/1993 | Wurdack . | |
| 5,299,779 | 4/1994 | Collins . | |

OTHER PUBLICATIONS

Drawing of jack, captioned: Barclay Furnishings Co., c/o Phil Andrews, Birmingham, Alabama Dec., 1993.

*Primary Examiner*—Robert C. Watson
*Attorney, Agent, or Firm*—Jenkens & Gilchrist, PC

[57] ABSTRACT

An apparatus for lifting furniture in place to install floor covering underneath the furniture. The apparatus comprises a plurality lifting assemblies. Each lifting assembly includes a substantially vertical piston and cylinder assembly. A piston rod is attached to each piston. The piston rod extends from the upper end of the piston and cylinder assembly and a substantially L-shaped member is attached to the piston rod. A pressurized fluid control system is constructed and arranged to uniformly supply pressurized fluid to the lifting assemblies; whereby, the lifting assemblies act together to simultaneously lift furniture in one movement when pressurized fluid is uniformly supplied from the pressurized fluid control system to the lifting assemblies.

4 Claims, 3 Drawing Sheets

FIG. 2
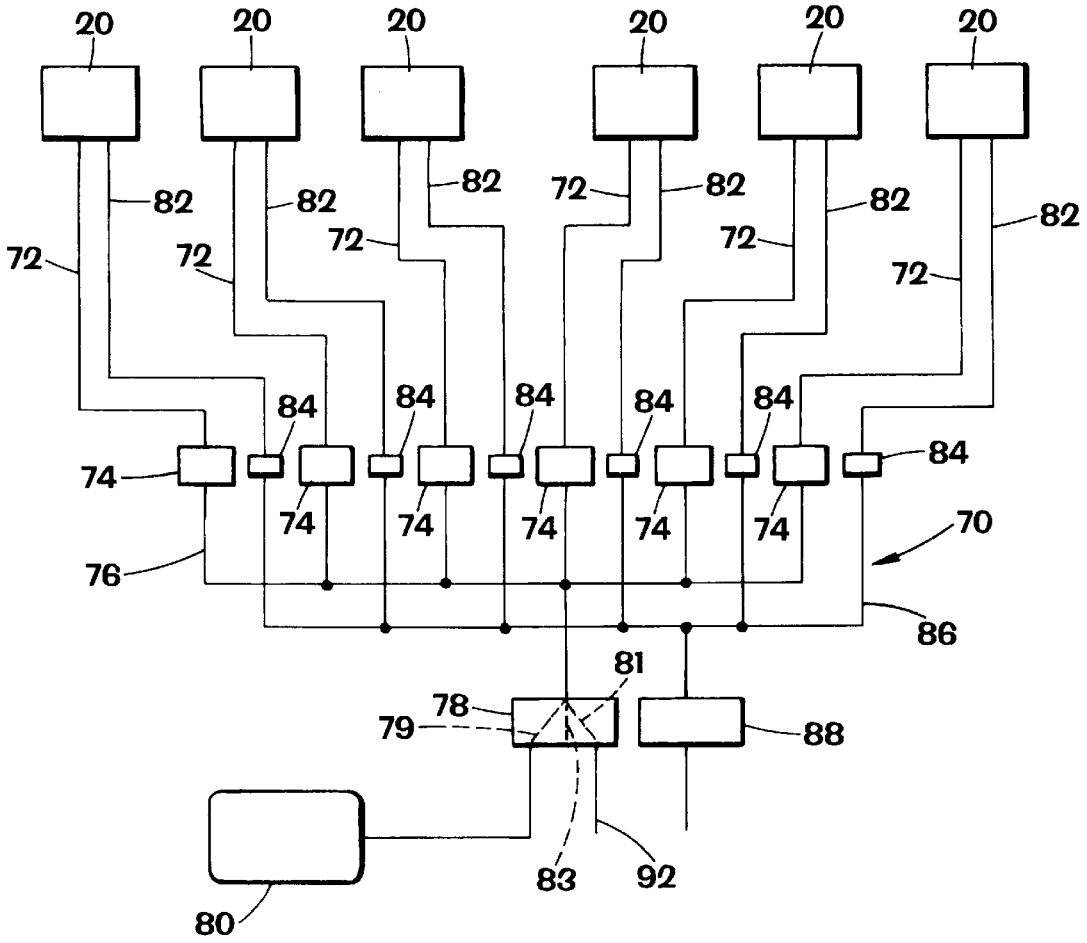
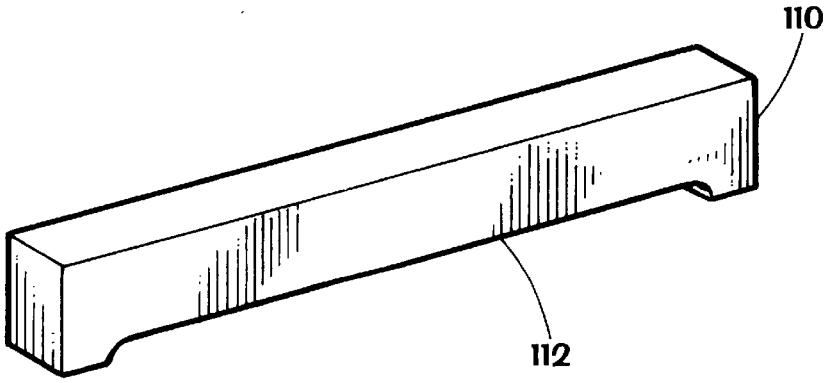
FIG. 3

APPARATUS FOR LIFTING FURNITURE IN PLACE TO INSTALL FLOOR COVERING BENEATH IT

This application is a continuation of Ser. No. 08/402,169 filed on Mar. 9, 1995 now abandoned.

FIELD OF THE INVENTION

This invention is in the field of apparatus and methods for lifting furniture in connection with the installation of floor covering beneath the furniture.

BACKGROUND

Installers of carpeting and other floor coverings are faced with numerous difficulties relating to installation of the floor coverings in locations where furniture has already been placed. Generally, such floor covering installation has required the installer to move all of the furniture to one side of a room while floor covering is installed in the furniture's original position, and then to move all of the furniture to the other side of the room to complete the installation. In the case of heavy furniture and modular furniture, this can be impractical and difficult. Often, the installer must disassemble such furniture in order to move it, increasing the difficulty and cost of the job.

Some in the art have attempted to use various types of jacks to lift furniture in place in order to avoid moving it. However, such attempts have met with limited success for a number of reasons. For example, they require several workers to operate the jacks at the same time, requiring a large work crew; if the jacks are not operated at the same time, the furniture may be warped or otherwise damaged. Moreover, even with the use of jacks, manual operation is difficult and tiring in the case of very heavy furniture.

It is therefore an object of the invention to provide an apparatus and method for enabling relatively few workers to lift heavy furniture and modular furniture in place for installing floor covering underneath without damaging the furniture.

SUMMARY OF THE INVENTION

An apparatus for lifting furniture in place to install floor covering beneath it, said apparatus comprises a plurality of lifting assemblies, said lifting assemblies include a substantially vertical piston and cylinder assembly; a piston rod attached to said piston, said piston rod extending from the upper end of said piston and cylinder assembly; a substantially L-shaped member attached to said piston rod; a pressurized fluid control system constructed and arranged to uniformly supply pressurized fluid to said lifting assemblies; whereby said lifting assemblies will simultaneously lift furniture in place when pressurized fluid is uniformly supplied from said pressurized fluid control system to said lifting assemblies.

BRIEF DESCRIPTION OF THE DRAWINGS

FIG. 2 is a schematic representation of the furniture lifting apparatus of the invention.

FIG. 3 is an illustration of a block preferably used to couple the L-shaped member of the lifting assembly of the invention to a piece of furniture having a toe-kick recess.

DETAILED DESCRIPTION OF THE INVENTION

The invention will now be described in detail with reference to the drawings, like numbers being used therein to label like parts.

Figure 1A:
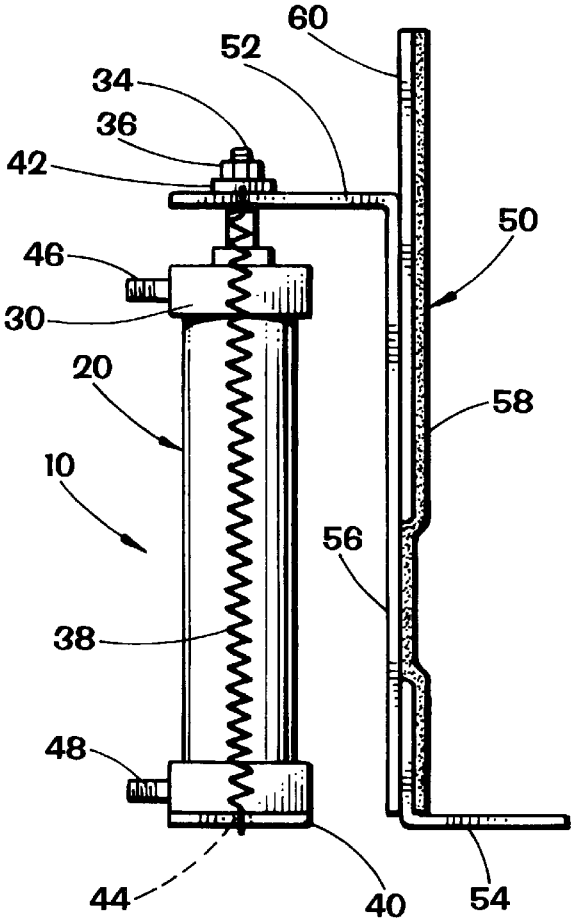
FIG. 1A is a side view of a preferred embodiment of the lifting assembly of the invention with the L-shaped member attached.
Figure 1B:
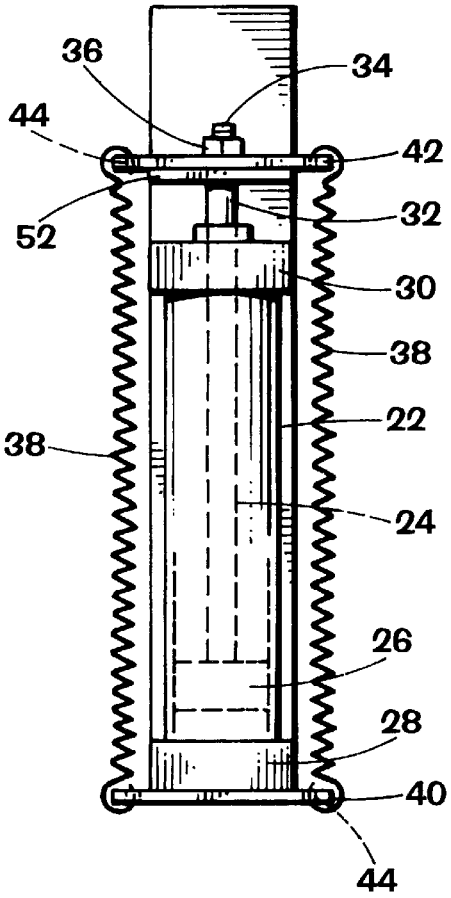
FIG. 1B is front view of FIG. 1A.
Figure 1C:
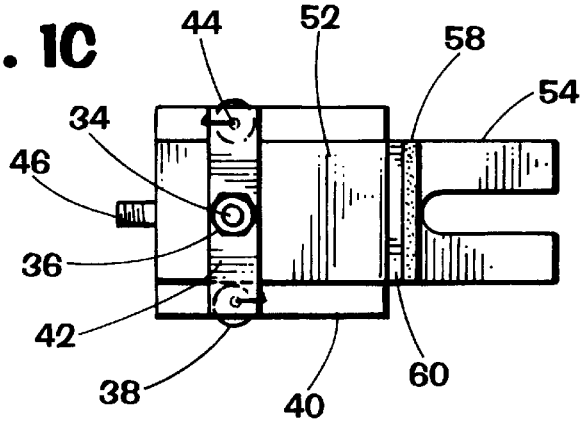
FIG. 1C is a top view of FIG. 1C.

FIGS. 1A, 1B and 1C show an apparatus for lifting furniture 10. The apparatus for lifting furniture 10 includes a substantially vertical piston and cylinder assembly 20. Piston and cylinder assembly 20 includes a cylinder 22, and a piston 26 connected to a piston rod 24 disposed within cylinder 22. Piston and cylinder assembly 20 also has a bottom end cap 28 and a top end cap 30 for sealing the cylinder and for coupling it to flow fittings 46 and 48. At the top of piston rod 24 is a portion 32 that extends out of cylinder 22. At the top end of piston rod 24 is a threaded end 34 for mounting to L-shaped member 50. In a preferred embodiment, nut 36 secures a top plate 42 and an upper plate 52 of L-shaped member 50 against the top of piston rod 24, thus mounting L-shaped member 50 to lifting assembly 20. Also, preferably a spring 38 is mounted to bottom plate 40 and top plate 42 of lifting assembly 20 by means of holes 44 in order to provide a means of biasing lifting assembly 20 in the retracted position.

L-shaped lifting member 50 includes backing plate 60, riser plate 56, a right-angled lower plate 54, and an upper plate 52, all preferably made of a rigid material such as steel In a preferred embodiment, upper plate 52 and riser plate 56 are a unitary piece. Backing plate 60 and lower plate 54 are securely attached to riser plate 56 by any suitable means such as welding. Preferably, padding 58 is mounted to the surface of L-shaped member 50 that will contact the furniture to be lifted. The padding may be made of carpet or other soft but durable material. Lower plate 54 may be bifurcated, as shown in the drawing, or may be solid.

FIG. 2 is a schematic representation of fluid control system 70. In a preferred embodiment, a plurality of lifting assemblies 20 are used, and an air compressor with a reservoir tank is used as source of pressurized fluid 80. Each lifting assembly 20 has a supply hose 72 extending from flow fitting 48 to one side of a supply valve 74. The other side of supply valve 74 is coupled to supply manifold 76, which in turn is coupled to main supply valve 78. Preferably, main supply valve 78 has three positions, shown as dashed lines 79, 81 and 83. In the position shown by dashed line 79, main supply valve 78 allows fluid communication between supply manifold 76 and a source of pressurized fluid 80. In the position shown by dashed line 81, main supply valve allows fluid communication between supply manifold 76 and conduit 82, which may be open to the atmosphere or re-routed to the inlet of source of pressurized fluid 80. In the position shown by dashed line 83, supply manifold 76 is effectively sealed.

Each lifting assembly 20 also has an exhaust hose 92 coupled between flow fitting 46 and one side of a coupling 84. The other side of coupling 84 is coupled to an exhaust manifold 86, which preferably in turn is coupled to one end of an exhaust valve 88. Preferably, supply hoses 72 and exhaust hoses 92 are made of a light weight flexible material capable of withstanding fluid pressure. In this manner, lifting assemblies 20 may freely be moved around the furniture 120 without moving the source of pressurized fluid 80 or manifolds 76 and 86.

Figure 5B:
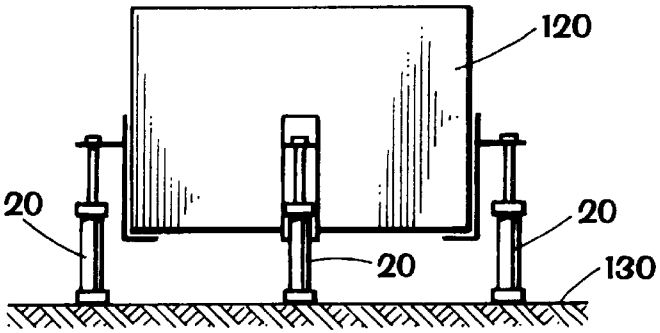
FIG. 5B is an illustration of a piece of furniture after lifting assemblies have lifted it in place according to the method of the invention.
Figure 5C:
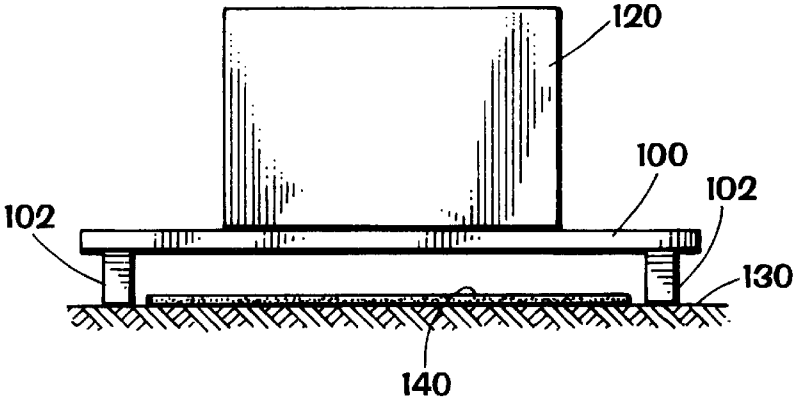
FIG. 5C is an illustration of a piece of furniture after lifting assemblies have been removed and a beam has been placed underneath the furniture to support it according to the method of the invention.
Figure 4:
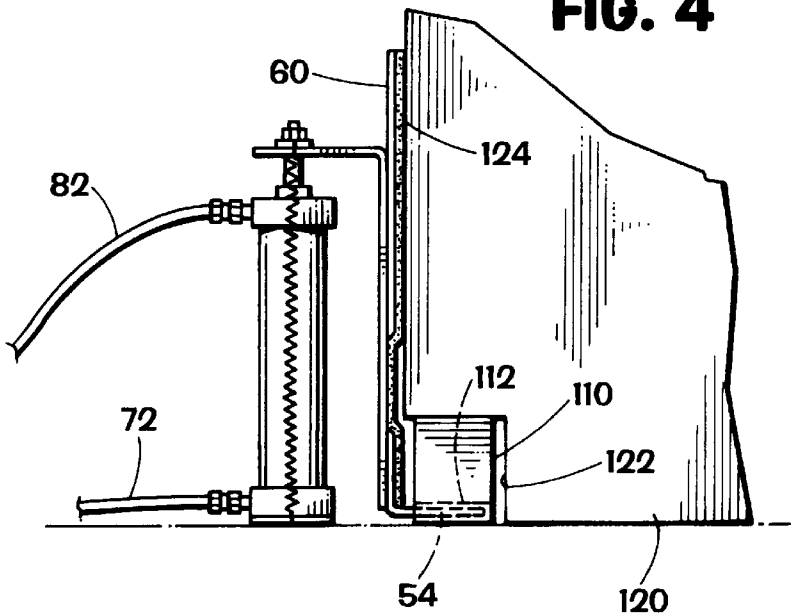
FIG. 4 is an illustration of a lifting assembly of the invention coupled to a piece of furniture having a toe-kick recess.
Figure 5A:
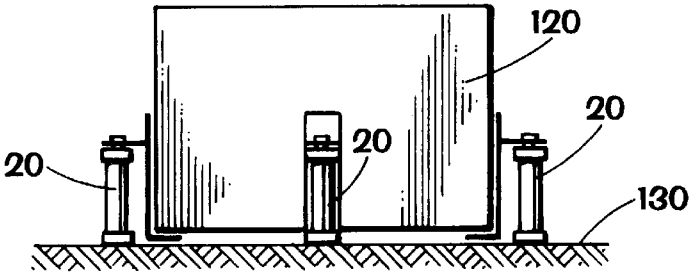
FIG. 5A is an illustration of a piece of furniture after lifting assemblies have been placed under it in preparation for lifting the furniture in place according to the method of the invention.

In operation, with main supply valve 78 in the off position 79, a plurality of lifting assemblies 20 are placed around a piece of furniture 120 at positions suitable for applying distributed force to the furniture without damaging it or tilting it when lifting assemblies 20 are energized simultaneously. This step is shown in FIG. 5A. Supply valves 74 are turned on for those lifting assemblies 20 that are placed around the furniture 120. When all of the lifting assemblies 20 are not needed, those not placed around the furniture 120 are disabled by turning off the corresponding supply valve 74. Then, main supply valve is placed in the on position 81, thereby communicating pressurized fluid from source 80 through manifold 76 into supply hose 72 and finally into lifting assembly 20. In this manner, a uniform supply of pressurized fluid is communicated to all lifting assemblies 20 that are energized by means of their corresponding supply valve 74 being in the on position. The result is that all of the energized lifting assemblies rise together simultaneously, lifting heavy furniture 120 without tilting it or damaging it. Main supply valve 78 may then be turned into its off position 83. This step is shown in FIG. 5B. Only one worker is required to place the lifting assemblies and operate the valves.

Once furniture 120 is lifted, a beam 100 is placed underneath it to support it, and lifting assemblies 20 may be removed. Supports 102 are spaced at a distance wide enough to allow floor covering 140 to be unrolled and installed underneath furniture 120 on floor 130. This step is shown in FIG. 5C. Once the floor covering 140 has been installed, lifting assemblies 20 are replaced under furniture 120 and the process is reversed. Beam 100 is removed, and main supply valve 78 is placed in position 81, allowing the pressurized fluid in manifold 76 to discharge, lowering the furniture evenly to the floor 130 on top of newly-installed floor covering 140.

It has been noted that certain types of furniture 120 are built with a toe-kick recess 122. In such a case, L-shaped lifting member 50 is preferably coupled to furniture 120 by means of a block 110. Typically, block 110 is constructed using a length of 2×4 lumber. A slot 112 is cut in the block 110, as shown in FIG. 3. This enables lower plate 54 to slide under block 110 after block 110 is inserted into toe-kick recess 122. At the same time, the vertical portion of L-shaped member 50 (preferably backing plate 60, riser plate 56 with padding 58) contacts the vertical portion 124 of furniture 120. In this manner, the force of lifting assembly 20 is applied to furniture evenly, and the range of motion of lifting assembly 20 is preserved so that furniture 120 may be lifted as high off the floor 130 as it would have been had there been no toe-kick recess 122.

While the invention has been described in detail with reference to a specific embodiment thereof, modifications and adaptations of the invention will be suggested to those having skill in the art and having reference to this specification and accompanying drawings. For example, the number of lifting assemblies 20 may be increased or decreased as required. It is to be understood that the invention is not limited to the particular forms disclosed, but rather encompasses all modifications, equivalents and alternatives falling within the spirit and scope of the invention as defined by the following claims.

I claim:

1. An apparatus for lifting furniture in place to install floor covering beneath, said apparatus comprising:

a plurality of lifting assemblies, said lifting assemblies including:

a substantially vertical piston and cylinder assembly;

a piston rod attached to said piston, said piston rod extending from the upper end of said piston and cylinder assemblies;

a substantially L-shaped member constructed and arranged for placement under a piece of furniture attached to said piston rod;

means for biasing said lifting assemblies when said substantially vertical piston and cylinder assemblies are in their retracted position;

a pressurized fluid control system constructed and arranged to uniformly supply pressurized fluid to said biased lifting assemblies;

whereby said biased lifting assemblies will simultaneously lift furniture in place for the installation of floor covering thereunder when pressurized fluid is uniformly supplied from said pressurized fluid control system to said lifting assemblies.

2. The apparatus as defined in claim 1 wherein said substantially L-shaped member includes and upper plate for attachment to said piston rod and a lower plate constructed and arranged to engage the piece of furniture.

3. The apparatus as defined in claim 2 wherein said substantially L-shaped member further includes a riser plate between said upper plate and said lower plate.

4. The apparatus as defined in claim 1 wherein said pressurized fluid control system further includes:

a control valve associated with each of said plurality of lifting assemblies;

a manifold interconnecting to each control valve;

a main supply valve interconnected to said manifold.

* * * * *